US008434930B2

(12) United States Patent
Huhta

(10) Patent No.: US 8,434,930 B2
(45) Date of Patent: May 7, 2013

(54) MAGNETICALLY-COUPLED STIRRING APPARATUS WITH SENSOR AND RELATED METHOD

(75) Inventor: Jeffrey Mark Huhta, Loveland, CO (US)

(73) Assignee: Hach Company, Loveland, CO (US)

( * ) Notice: Subject to any disclaimer, the term of this patent is extended or adjusted under 35 U.S.C. 154(b) by 801 days.

(21) Appl. No.: 12/529,589

(22) PCT Filed: Feb. 20, 2008

(86) PCT No.: PCT/US2008/054462

§ 371 (c)(1),
(2), (4) Date: Sep. 2, 2009

(87) PCT Pub. No.: WO2008/112395

PCT Pub. Date: Sep. 18, 2008

(65) Prior Publication Data

US 2010/0020635 A1 Jan. 28, 2010

Related U.S. Application Data

(60) Provisional application No. 60/894,329, filed on Mar. 12, 2007.

(51) Int. Cl.
*B01F 13/08* (2006.01)

(52) U.S. Cl.
USPC ..... 366/129; 356/142; 356/273

(58) Field of Classification Search ..... 366/129, 366/273, 274, 342, 343, 142; 99/277.2; 435/302.1; 416/3

See application file for complete search history.

(56) References Cited

U.S. PATENT DOCUMENTS

| | | | | |
|---|---|---|---|---|
| 3,140,079 | A * | 7/1964 | Baermann | 366/274 |
| 3,730,488 | A * | 5/1973 | Gardner, Jr. | 366/262 |
| 4,046,515 | A * | 9/1977 | de Leeuw | 422/514 |
| 4,465,377 | A * | 8/1984 | de Bruyne | 366/273 |
| 6,461,034 | B1 | 10/2002 | Clevland | |
| 8,173,438 | B1 * | 5/2012 | Putnam et al. | 436/138 |
| 2005/0087002 | A1 * | 4/2005 | Kanzaki et al. | 73/54.28 |
| 2007/0053238 | A1 * | 3/2007 | Kocienski | 366/273 |
| 2010/0020635 | A1 * | 1/2010 | Huhta | 366/274 |

FOREIGN PATENT DOCUMENTS

| | | | |
|---|---|---|---|
| EP | 0822000 | A1 | 2/1998 |
| JP | 2005/254113 | A | 9/2005 |

* cited by examiner

*Primary Examiner* — Charles E Cooley
(74) *Attorney, Agent, or Firm* — Ference & Associates LLC

(57) ABSTRACT

A magnetically-coupled stirring apparatus is provided. The stirring apparatus includes a rotor including at least one rotor magnet, with the rotor being positioned within a chamber. The stirring apparatus further includes an offset stirrer device positioned outside of the chamber. The offset stirrer device includes a shaft including a first end and a second end, with a stirring device axis being offset from a rotor axis, one or more paddle portions extending from the second end, and at least one stirrer magnet affixed to the first end. The at least one rotor magnet magnetically interacts with the at least one stirrer magnet. Rotation of the rotor induces rotation of the offset stirrer device.

21 Claims, 6 Drawing Sheets

SECTION 33

MAGNETICALLY-COUPLED STIRRING APPARATUS WITH SENSOR AND RELATED METHOD

BACKGROUND OF THE INVENTION

1. Field of the Invention

The invention is related to the field of stirring apparatuses, and in particular, to a magnetically-coupled stirring apparatus and method.

2. Statement of the Problem

In laboratory or field testing situations, a sample fluid can be tested and analyzed for certain properties. Prior to such a test, it is generally desirable that the sample fluid be thoroughly mixed or stirred. This may be necessary because if the sample fluid has not been collected recently, then the contents may have separated, settled, or otherwise become non-uniform. An optimum test will rely on uniformity of the sample fluid. In addition, where the component or characteristic to be tested for is not plentiful, stirring of the sample fluid may bring a greater volume of the sample fluid into contact with a sensor.

In water quality testing, a water sample can be tested for oxygen content, such as the amount of oxygen that is dissolved in the water, for example. Such testing requires that the dissolved oxygen be uniformly dispersed in the water in order to obtain an accurate reading. Trending measurements of the dissolved oxygen can indicate the level of bacterial activity and/or a type of bacterial activity, for example. For wastewater and drinking water treatment, a measurement of dissolved oxygen may indicate whether the treatment process is being properly performed.

In natural waters, dissolved oxygen exists in a dynamic equilibrium that is controlled by biochemical depletion and oxygenation through atmospheric diffusion, aeration, and photosynthesis. However, as microbial growth in the water degrades organic matter, oxygen is consumed. Oxygen is re-supplied through atmospheric diffusion, aeration, and photosynthesis. As a result, bacterial populations proliferate and provide a key input on up the food chain.

The equilibrium of dissolved oxygen is subject to detrimental fluxes when a catastrophic event occurs, such as organic waste being discharged into the water. An immediate depletion in dissolved oxygen results in an anoxic environment. Depending on the severity of the event, the dissolved oxygen may be depleted to the point where higher trophic organisms such as macro invertebrates and fish are killed off.

In wastewater, organic-based sewage is degraded under controlled aerobic conditions. Failure to maintain adequate supplies of dissolved oxygen can result in anaerobic conditions that lead to offensive and corrosive sulfides. On the other hand, excessive aeration is wasteful and drives up operational costs.

When dissolved oxygen is reported in aeration basins and outfalls or used to derive the biochemical oxygen demand from wastewater, it becomes a regulatory tool. Thus, prudent monitoring of dissolved oxygen is essential for assessing environmental risk in natural waters. It is also necessary for optimal wastewater treatment performance and for ensuring regulatory compliance.

The level of dissolved oxygen can be measured using a Luminescent Dissolved Oxygen (LDO) sensor. The speed of the measurement performed by the LDO sensor is directly affected by the amount of stirring of the sample. The stirring affects the speed of the test by bringing the dissolved oxygen in the water into contact with or into the region of the emitted light and therefore accelerates the test process.

FIG. 1 shows a magnetic stirrer device of the prior art. The prior art magnetic stirrer device includes a stirring magnet (the upper magnet in the drawing) that rests on the bottom of a container. The prior art magnetic stirrer device includes a magnet that is rotated by a motor or other rotary power source, such as the lower magnet in the drawing. Rotation of the lower magnet about its axis causes the upper magnet to rotate about the same axis and follow the lower magnet. Consequently, the two magnets rotate about a common axis, i.e., they are coaxial.

SUMMARY OF THE INVENTION

A magnetically-coupled stirring apparatus is provided according to the invention. The magnetically-coupled stirring apparatus includes a rotor including at least one rotor magnet. The rotor is positioned within a chamber. The magnetically-coupled stirring apparatus further includes an offset stirrer device positioned outside of the chamber. The offset stirrer device comprises a shaft including a first end and a second end, with a stirring device axis being offset from a rotor axis, one or more paddle portions extending from the second end, and at least one stirrer magnet affixed to the first end. The at least one rotor magnet magnetically interacts with the at least one stirrer magnet. Rotation of the rotor induces rotation of the offset stirrer device.

A magnetically-coupled stirring apparatus is provided according to the invention. The magnetically-coupled stirring apparatus comprises a rotor including at least one rotor magnet. The rotor is positioned within a chamber. The magnetically-coupled stirring apparatus further comprises an offset stirrer device positioned outside of the chamber. The offset stirrer device comprises a shaft including a first end and a second end, with a stirring device axis being offset from a rotor axis, one or more paddle portions extending from the second end, and at least one stirrer magnet affixed to the first end. The at least one rotor magnet magnetically interacts with the at least one stirrer magnet. Rotation of the rotor induces rotation of the offset stirrer device. The magnetically-coupled stirring apparatus further comprises one or more sensors located adjacent to the one or more paddle portions. The offset stirrer device moves a fluid adjacent to the one or more sensors.

A method for creating a stirring apparatus for displacing a fluid is provided according to the invention. The method comprises positioning a rotor inside a chamber. The rotor includes at least one rotor magnet. The method further comprises positioning an offset stirrer device outside of the chamber. The offset stirrer device comprises a shaft including a first end and a second end, one or more paddle portions extending from the second end, and at least one stirrer magnet affixed to the first end. A stirring device axis is offset from a rotor axis. The at least one rotor magnet magnetically interacts with the at least one stirrer magnet and rotation of the rotor induces rotation of the offset stirrer device.

Aspects of the Invention

In one aspect of the stirring apparatus, the stirring apparatus further comprising one or more sensors located adjacent to the one or more paddle portions and with the offset stirrer device moving a fluid adjacent to the one or more sensors.

In another aspect of the stirring apparatus, a stirring device axis is non-coaxial with a rotor axis.

In yet another aspect of the stirring apparatus, a stirring device axis is substantially parallel to and non-coaxial with a rotor axis.

In yet another aspect of the stirring apparatus, a stirring device axis is at an angle to a rotor axis.

In yet another aspect of the stirring apparatus, a stirring device axis is substantially perpendicular to a rotor axis.

In yet another aspect of the stirring apparatus, the at least one stirrer magnet is radially displaced from the at least one rotor magnet.

In yet another aspect of the stirring apparatus, the at least one stirrer magnet is radially displaced and axially displaced from the at least one rotor magnet.

In one aspect of the method, the stirring apparatus further comprising one or more sensors located adjacent to the one or more paddle portions and with the offset stirrer device moving a fluid adjacent to the one or more sensors.

In another aspect of the method, a stirring device axis is non-coaxial with a rotor axis.

In yet another aspect of the method, a stirring device axis is substantially parallel to and non-coaxial with a rotor axis.

In yet another aspect of the method, a stirring device axis is at an angle to a rotor axis.

In yet another aspect of the method, a stirring device axis is substantially perpendicular to a rotor axis.

In yet another aspect of the method, the at least one stirrer magnet is radially displaced from the at least one rotor magnet.

In yet another aspect of the method, the at least one stirrer magnet is radially displaced and axially displaced from the at least one rotor magnet.

DESCRIPTION OF THE DRAWINGS

The same reference number represents the same element on all drawings. It should be understood that the drawings are not necessarily to scale.

DETAILED DESCRIPTION OF THE INVENTION

FIGS. 2-12 and the following description depict specific examples to teach those skilled in the art how to make and use the best mode of the invention. For the purpose of teaching inventive principles, some conventional aspects have been simplified or omitted. Those skilled in the art will appreciate variations from these examples that fall within the scope of the invention. Those skilled in the art will appreciate that the features described below can be combined in various ways to form multiple variations of the invention. As a result, the invention is not limited to the specific examples described below, but only by the claims and their equivalents.

Figure 1:
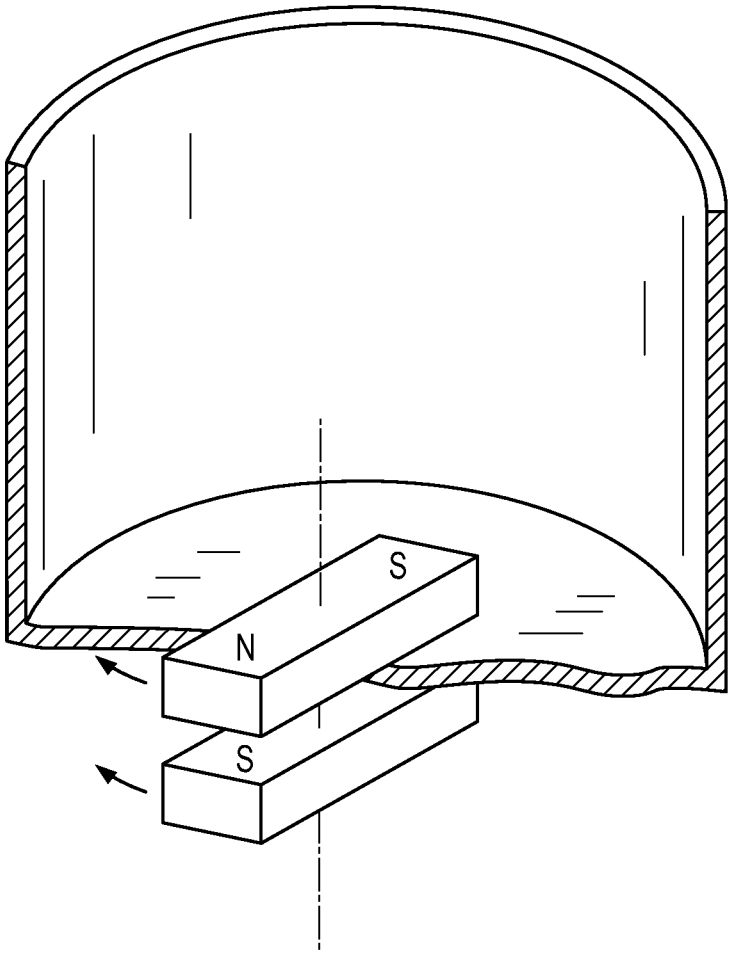
PRIOR ART FIG. 1
FIG. 1 shows a magnetic stirrer device of the prior art.
Figure 2:
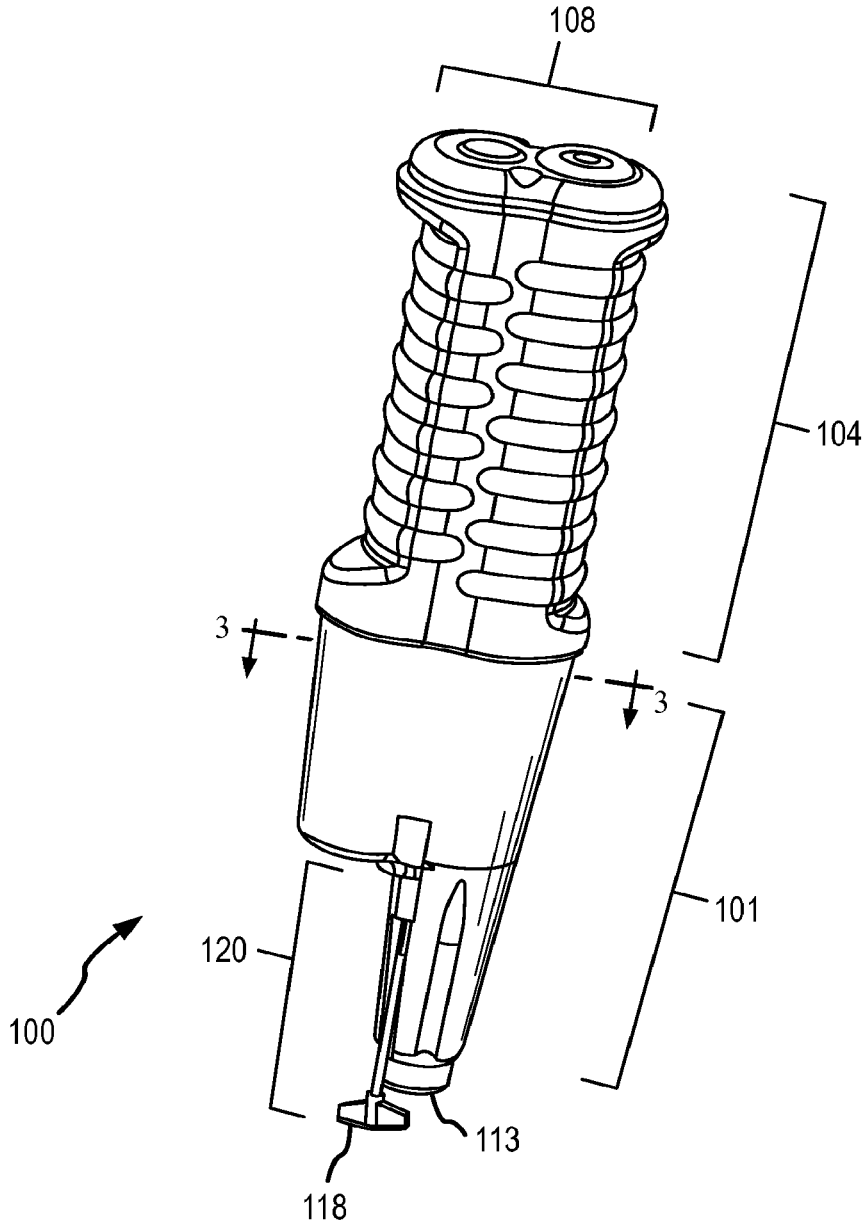
FIG. 2 shows a stirring apparatus according to an embodiment of the invention.

FIG. 2 shows a stirring apparatus 100 according to an embodiment of the invention. The stirring apparatus 100 includes a body 101, a handle or grip portion 104, and a control panel 108. The stirring apparatus 100 can further include one or more sensors 113 and a stirrer device 120. The stirrer device 120 can include one or more paddle portions 118. The stirrer device 120 is positioned to stir a fluid in the vicinity of the one or more sensors 113.

In use, at least a portion of the stirring apparatus 100 is inserted into a liquid sample. The stirrer device 120 can be energized in order to stir the sample liquid. The sample liquid can be stirred in order to create a homogenous sample. The sample liquid can be stirred in order to mix two or more components of the sample. The sample liquid can be stirred in order to mix and distribute solids or liquids in suspension in the sample.

In some embodiments, the stirring apparatus 100 moves the surrounding liquid in an at least partially radial and/or circular fashion. In some embodiments, the stirring apparatus 100 moves the surrounding liquid in an at least partially axial fashion. Consequently, the liquid is moved in relation to and/or over the sensor 113.

Figure 3:
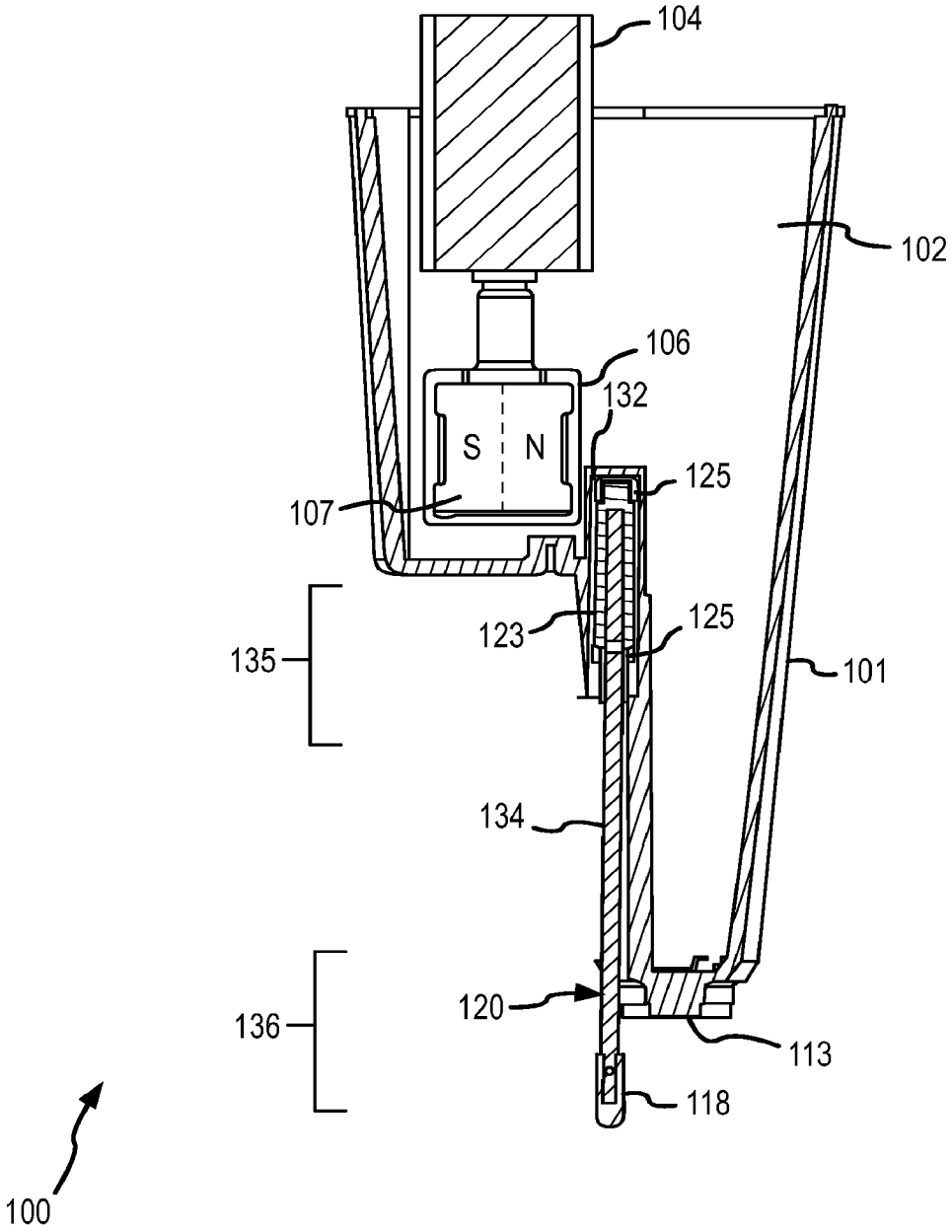
FIG. 3 is a section view 3-3 of the stirring apparatus according to an embodiment of the invention.

The stirrer device 120 can be rotated by an internal rotary power source (see FIG. 3). The stirring apparatus 100 can include a power source connected to the control panel 108. A user can grip the handle portion 104 and can energize and de-energize the stirrer device 120 using the control panel 108.

FIG. 3 is a section view 3-3 of the stirring apparatus 100 according to an embodiment of the invention. The body 101 includes a chamber 102. The chamber 102 can receive, among other things, a motor 104 and associated rotor 106 and one or more sensors 113. The motor 104, the rotor 106, and the one or more sensors 113 can be sealed within the chamber 102. Other components can be included in the chamber 102, including circuitry for the one or more sensors 113 (not shown) and an electrical power source (not shown).

The one or more sensors 113 can comprise any manner of sensors for measuring properties or characteristics of a fluid. In some embodiments, the one or more sensors 113 includes a fluid sensor. In some embodiments, the one or more sensors 113 includes an optical sensor. In some embodiments, the one or more sensors 113 includes a dissolved oxygen (DO) sensor, such as a luminescent dissolved oxygen (LDO) sensor. However, other sensors are contemplated and are within the scope of the description and claims.

The stirring apparatus 100 can be designed to be immersed in a fluid. For example, the stirring apparatus 100 can be configured to be inserted at least partially into a sample container that holds a fluid to be tested. For example, the stirring apparatus 100 can be designed to fit into and/or attach to a sample container, such as by fitting to or screwing onto a top of a sample bottle (not shown). Alternatively, the stirring apparatus 100 can be inserted into an open body of fluid. The stirring apparatus 100 can be designed to stir, agitate, move, and/or mix the fluid. Consequently, the chamber 102 can be substantially fluid tight. In some embodiments, there are no access ports or openings leading into the chamber 102. Therefore any circuitry located in the chamber 102 cannot be corroded, short-circuited, or otherwise affected or damaged by fluids.

In the prior art, a stirring device shaft is typically constructed to extend from within a chamber to the outside, using one or more seals. Unfortunately, such an arrangement can leak fluid into the chamber. The danger of such leakage increases with wear and/or age, wherein such seals typically lose effectiveness over time.

The rotor 106 is rotated by the motor 104 and can spin freely in the chamber 102. The rotor 106 can include at least one rotor magnet 107 and therefore at least two magnetic poles. The figure shows a rotor magnet 107 having one North pole and one corresponding South pole. However, it should be understood that the rotor 106 can include any number of rotor magnets 107 and associated magnetic poles (see FIG. 11, for example). The magnetic field created by the at least one rotor magnet 107 is arranged with lines of magnetic flux being substantially horizontal in the figure. The rotating magnetic field of the rotor magnet 107 can pass through the body 101.

The stirrer device 120 includes a stirrer shaft 134 including a first end 135 and a second end 136. At least one stirrer magnet 123 is affixed to or formed as a part of the first end 135. One or more paddle portions 118 are formed at the second end 136 and are rotated in order to perform the stirring function.

The stirrer device 120 is received in a socket 132 of the body 101. The socket 132 can be formed as part of the body 101 but does not include any opening or openings through the body 101 and into the chamber 102. The socket 132 includes one or more bearings 125. The one or more bearings 125 support the stirrer device 120 and allow the stirrer device 120 to rotate substantially freely within the socket 132.

As in the rotor magnet 107, the lines of magnetic flux of the at least one stirrer magnet 123 are substantially horizontal in the figure. The at least one rotor magnet 107 can magnetically couple with the at least one stirrer magnet 123. In this fashion, rotation of the rotor 106 can induce a rotation of the stirrer device 120. As shown in the figure, the rotor 106 and the at least one stirrer magnet 123 can be positioned in order to minimize the length of the magnetic flux lines, resulting in the smoothest rotational operation.

The magnetically induced rotation of the stirrer device 120 eliminates the need for any passage into the chamber 102. In addition, there is no need for any seals to seal the chamber 102. This reduces or eliminates the possibility of any moisture making its way into the chamber 102, preserving the life of the motor 104, the one or more sensors 113, and any associated circuitry and electrical power source.

The stirrer device 120 is not coaxial with the rotor 106. Unlike prior art magnetically coupled stirrer arrangements, the at least one rotor magnet 107 does not create an axial magnetic field that interacts with an axially located and non-radially offset stirring device.

The one or more paddle portions 118 of the stirrer device 120 can impart motion to the surrounding fluid. The one or more paddle portions 118 can comprise substantially planar portions in some embodiments. The one or more paddle portions 118 can be linearly arranged on the stirrer device 120 or can be angled. Where the one or more paddle portions 118 are angled, the one or more paddle portions 118 provide an axial velocity component to the surrounding fluid when the one or more paddle portions 118 are rotated. Alternatively, the one or more paddle portions 118 can include a twist that provides an axial velocity component to the surrounding fluid when the one or more paddle portions 118 are rotated.

The at least one rotor magnet 107 in the figure is substantially square or substantially rectangular. The comers of the at least one rotor magnet 107 can focus or direct the magnetic flux of the magnet or magnets. However, it should be understood that the rotor magnet 107 and the at least one stirrer magnet 123 can be of any shape.

The at least one rotor magnet 107 and the at least one stirrer magnet 123 can be of any size. The at least one rotor magnet 107 can be larger, smaller, or equal in size to the at least one stirrer magnet 123.

In some embodiments, the at least one rotor magnet 107 can be stronger than the at least one stirrer magnet 123. However, the at least one rotor magnet 107 can alternatively be equal to or weaker than the at least one stirrer magnet 123.

Advantageously, the stirring apparatus 100 offers no leakage access. Leakage due to a stirrer is not possible. The stirring apparatus 100 offers a low drive friction, without the need for any gears, belts, etc. The stirring apparatus 100 offers a simple design that is robust and economical to manufacture. The stirring apparatus 100 offers an ability to angle the stirrer device axis with respect to the motor axis (see FIG. 12 and the accompanying discussion).

Figure 4:
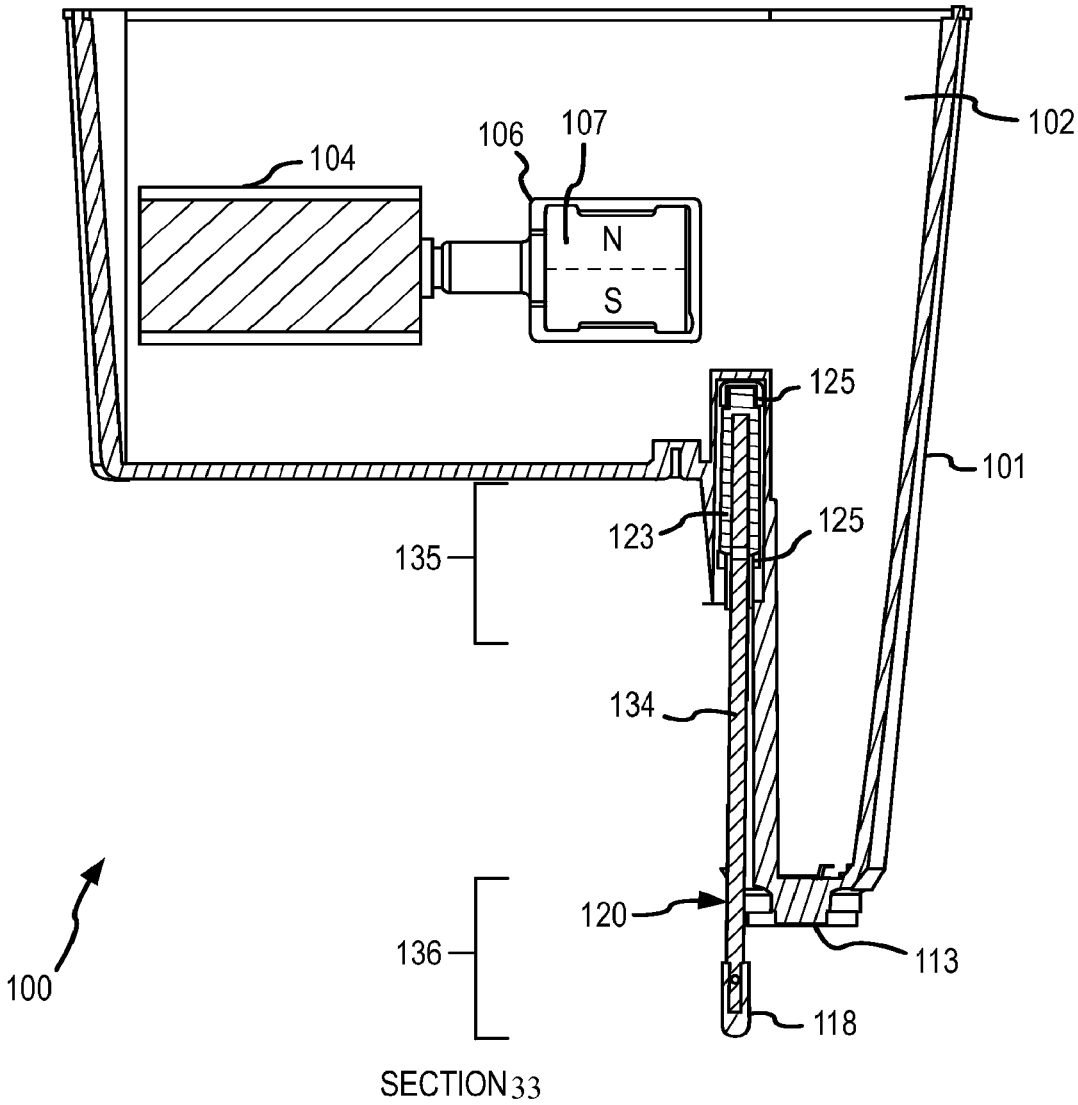
FIG. 4 shows the stirring apparatus according to an embodiment of the invention.

FIG. 4 shows the stirring apparatus 100 according to an embodiment of the invention. The motor 104 and the rotor 106 in this embodiment are at a substantially right angle (i.e., perpendicular) to the stirrer shaft 134. The motor 104 and the rotor 106 in this embodiment are offset from the stirring device 120. The motor 104 and the rotor 106 do not have to be aligned with or coaxial to and offset from the stirrer shaft 134.

Rotation of the rotor 106 in this configuration likewise induces rotation of the stirrer device 120. Consequently, the axis of the motor 104 and the rotor 106 can be offset from and at any angle to the stirrer device 120.

Figure 7:
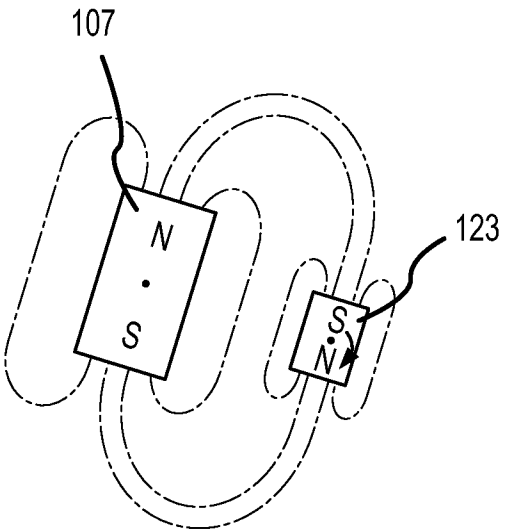
FIGS. 5-7 show an end-on view of the at least one rotor magnet and the at least one stirrer magnet according to an embodiment of the invention.
Figure 6:
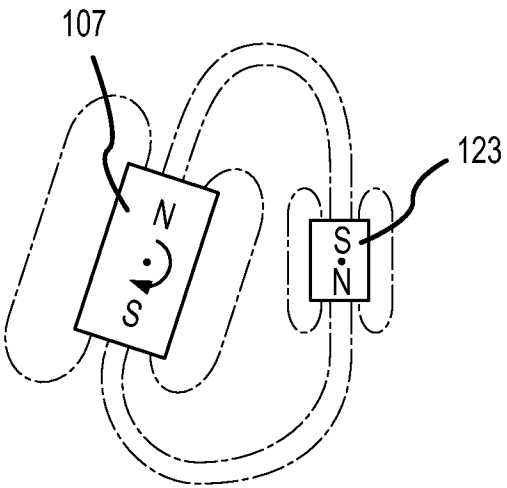
Figure 5:
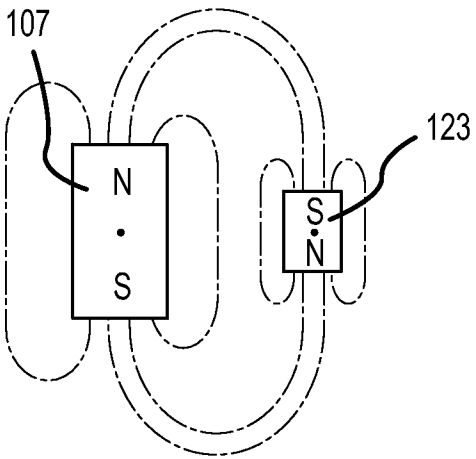

FIGS. 5-7 show an end-on view of the at least one rotor magnet 107 and the at least one stirrer magnet 123 according to an embodiment of the invention. For simplicity, the rotor magnet 107 and the stirrer magnet 123 are shown as each comprising a single magnet having North and South poles.

In FIG. 5, the stirrer magnet 123 is substantially aligned with the rotor magnet 107. The lines of magnetic flux emerging from the North pole of the rotor magnet 107 enter the South pole of the stirrer magnet 123, exit from the North pole of the stirrer magnet 123, and loop back to the South pole of the rotor magnet 107.

In FIG. 6, the rotor magnet 107 has been rotate somewhat in a clockwise direction. The lines of magnetic flux are no longer aligned between the rotor magnet 107 and the stirrer magnet 123. As a result, a rotational force will be imparted to the stirrer magnet 123 by the rotor magnet 107.

In FIG. 7, as a result of the rotation of the rotor magnet 107, the stirrer magnet 123 has rotated so that it is now aligned with the lines of magnetic flux emanating from the rotor magnet 107.

Figure 8:
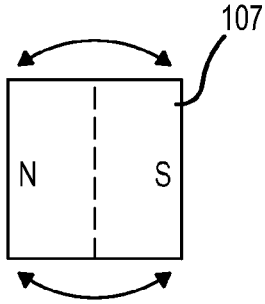
FIG. 8 shows the rotor magnet and/or the stirrer magnet according to an embodiment of the invention.

FIG. 8 shows the rotor magnet 107 and/or the stirrer magnet 123 according to an embodiment of the invention. In this embodiment, the magnet comprises a square or rectangular shape. The magnet of this embodiment includes a North pole portion and a South pole portion.

Figure 9:
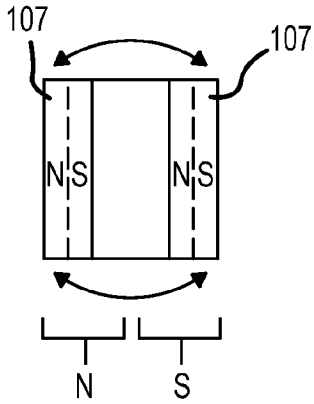
FIG. 9 shows the rotor magnet and/or the stirrer magnet according to an embodiment of the invention.

FIG. 9 shows the rotor magnet 107 and/or the stirrer magnet 123 according to an embodiment of the invention. In this embodiment, the magnet comprises two or more magnet portions with a core sandwiched between the magnet portions. This arrangement will still result in an overall North pole and South pole, as shown in the figure.

Figure 10:
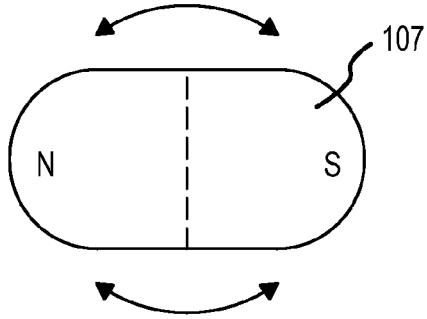
FIG. 10 shows the rotor magnet and/or the stirrer magnet according to an embodiment of the invention.

FIG. 10 shows the rotor magnet 107 and/or the stirrer magnet 123 according to an embodiment of the invention. In this embodiment, the magnet comprises a bar shape with rounded ends. However, it should be understood that the magnets can be formed of any shape.

Figure 11:
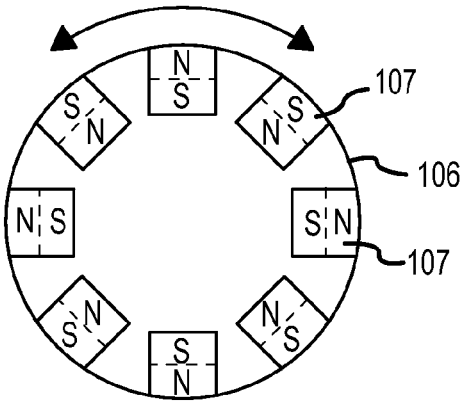
FIG. 11 shows the rotor magnet and/or the stirrer magnet according to an embodiment of the invention.

FIG. 11 shows the rotor magnet 107 and/or the stirrer magnet 123 according to an embodiment of the invention. In this embodiment, the magnet comprises multiple magnet sections. The magnet sections can be arranged in any desired manner. The magnet sections can be affixed to a carrier or substrate, cast into a potting compound, etc. As shown in the figure the magnetic poles are arranged in an alternating manner.

Figure 12:
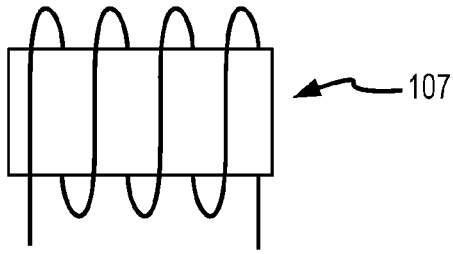
FIG. 12 shows the rotor magnet according to an embodiment of the invention.

FIG. 12 shows the rotor magnet 107 according to an embodiment of the invention. In this embodiment, the rotor magnet 107 comprises an electromagnet coil that produces a magnetic field when energized. The poles of the electromagnet can be swapped by changing the direction of the electrical current flowing through the electromagnet coil. As a result, the magnetic poles in this embodiment can be continuously and periodically swapped, inducing movement and/or rotation in the stirrer device 120.

What is claimed is:

1. A magnetically-coupled stirring apparatus, comprising:
a rotor including at least one rotor magnet, with the rotor being positioned within a chamber; and
a stirrer device positioned outside of the chamber, with the stirrer device comprising:
a shaft including a first end and a second end, with a stirring device axis being offset from a rotor axis;
one or more paddle portions extending from the second end;
at least one stirrer magnet affixed to the first end, wherein the at least one rotor magnet magnetically interacts with the at least one stirrer magnet and wherein rotation of the rotor induces rotation of the stirrer device; and
one or more sensors located adjacent to the one or more paddle portions.

2. The stirring apparatus of claim 1, with a stirring device axis being non-coaxial with a rotor axis.

3. The stirring apparatus of claim 1, with a stirring device axis being substantially parallel to and non-coaxial with a rotor axis.

4. The stirring apparatus of claim 1, with a stirring device axis being at an angle to a rotor axis.

5. The stirring apparatus of claim 1, with a stirring device axis being substantially perpendicular to a rotor axis.

6. The stirring apparatus of claim 1, with the at least one stirrer magnet being radially displaced from the at least one rotor magnet.

7. The stirring apparatus of claim 1, with the at least one stirrer magnet being radially displaced and axially displaced from the at least one rotor magnet.

8. A magnetically-coupled stirring apparatus, comprising:
a rotor including at least one rotor magnet, with the rotor being positioned within a chamber; and
an offset stirrer device positioned outside of the chamber, with the offset stirrer device comprising:
a shaft including a first end and a second end, with a stirring device axis being offset from a rotor axis;
one or more paddle portions extending from the second end;
at least one stirrer magnet affixed to the first end, wherein the at least one rotor magnet magnetically interacts with the at least one stirrer magnet and wherein rotation of the rotor induces rotation of the offset stirrer device; and
one or more sensors located adjacent to the one or more paddle portions thereby causing a fluid to move adjacent to the one or more sensors.

9. The stirring apparatus of claim 8, with a stirring device axis being non-coaxial with a rotor axis.

10. The stirring apparatus of claim 8, with a stirring device axis being substantially parallel to and non-coaxial with a rotor axis.

11. The stirring apparatus of claim 8, with a stirring device axis being at an angle to a rotor axis.

12. The stirring apparatus of claim 8, with a stirring device axis being substantially perpendicular to a rotor axis.

13. The stirring apparatus of claim 8, with the at least one stirrer magnet being radially displaced from the at least one rotor magnet.

14. The stirring apparatus of claim 8, with the at least one stirrer magnet being radially displaced and axially displaced from the at least one rotor magnet.

15. A method for creating a stirring apparatus for displacing a fluid, with the method comprising:
positioning a rotor inside a chamber, with the rotor including at least one rotor magnet; and
positioning a stirrer device outside of the chamber, with the stirrer device comprising a shaft including a first end and a second end, one or more paddle portions extending from the second end, one or more sensors located adjacent to the one or more paddle portions, and at least one stirrer magnet affixed to the first end, where a stirring device axis is offset from a rotor axis,
wherein the at least one rotor magnet magnetically interacts with the at least one stirrer magnet, and wherein rotation of the rotor induces rotation of the offset stirrer device.

16. The method of claim 15, with a stirring device axis being non-coaxial with a rotor axis.

17. The method of claim 15, with a stirring device axis being substantially parallel to and non-coaxial with a rotor axis.

18. The method of claim 15, with a stirring device axis being at an angle to a rotor axis.

19. The method of claim 15, with a stirring device axis being substantially perpendicular to a rotor axis.

20. The method of claim 15, with the at least one stirrer magnet being radially displaced from the at least one rotor magnet.

21. The method of claim 15, with the at least one stirrer magnet being radially displaced and axially displaced from the at least one rotor magnet.

* * * * *